United States Patent [19]

Lautenschläger

[11] Patent Number: 4,457,047

[45] Date of Patent: Jul. 3, 1984

[54] OVER-CENTER SELF-CLOSING HINGE HAVING A SPRING BIASED CAM THRUSTER

[75] Inventor: Karl Lautenschläger, Reinheim, Fed. Rep. of Germany

[73] Assignee: Karl Lautenschläger K.G., Möbelbeschlagfabrik, Reinheim, Fed. Rep. of Germany

[21] Appl. No.: 416,004

[22] Filed: Sep. 8, 1982

[30] Foreign Application Priority Data

Sep. 22, 1981 [DE] Fed. Rep. of Germany ..... 3137552

[51] Int. Cl.[3] ..... E05F 1/08

[52] U.S. Cl. ..... 16/288; 16/72; 16/291; 16/294; 16/302; 16/360

[58] Field of Search ..... 16/50, 72, 288, 291, 16/294, 302, 304, 335, 360, 370

[56] References Cited

U.S. PATENT DOCUMENTS 4,065,829 1/1978 Lautenschlager ..... 16/294

4,310,948 1/1982 Rock et al. ..... 16/288 X

FOREIGN PATENT DOCUMENTS 2337224 2/1975 Fed. Rep. of Germany ..... 16/291

*Primary Examiner*—Fred Andrew Silverberg

[57] ABSTRACT

Over-center hinge (10) whose jamb-related part is in the form of a supporting arm (16) coupled by two links (18 and 20) to the door-related part (14) in the manner of a four-joint hinge. In the linkage end of the supporting arm (16) there is provided a thruster (26) whose one end is mounted so as to be longitudinally displaceable under resilient bias and rotatable about the fixed pivot (28) of one of the hinge links (18), and whose other end, which is provided with a cam (42–44), is urged against a crosspiece (36) in the supporting arm (16). By way of studs (50) on the other hinge link (20), which are guided by a cam (48), the thruster (26) is swung during the hinge movement, while in the vicinity of the closed position a ramp surface (44) cooperates with the crosspiece (36) in such a manner that the thruster (26) is swung towards the second hinge link (20) and exerts a force thereon acting in the closing direction.

7 Claims, 9 Drawing Figures

OVER-CENTER SELF-CLOSING HINGE HAVING A SPRING BIASED CAM THRUSTER

BACKGROUND OF THE INVENTION

The invention relates to an over-center, self-closing hinge for cabinet doors, having two hinge links pivoting in the manner of a four-joint hinge on a door-related hinge part at one end and on a jamb-related hinge part in the form of an elongated supporting arm at the other, and having a biased spring one end of which thrusts against the jamb-related pivot of the outer hinge link, i.e., the link more remote from the jamb, and whose other end thrusts against the inner hinge link, i.e., the link nearer the jamb, at a point at a distance froom its jamb-end pivot, so as to produce a hinge closing torque when the hinge is close to its closed position.

An over-center, self-closing hinge of this kind is known from U.S. Pat. No. 4,065,829, in which the spring under bias is an arcuately curved spring whose one end thrusts against the pivot of the outer hinge link while its other end engages a pin disposed transversely between two side plates formed on the inner hinge link. As a result of the distance between the transverse pin and the pin mounting the inner hinge link, the bias of the spring engages the inner hinge link with mechanical advantage, such that, as the hinge nears the closed position, a torque acting in the closing direction is produced by the bias, and, as it nears the open position, a torque acting in the opening direction is produced. The known hinge thus has an over-center characteristic which forces the hinge to one of its end positions depending on the angle of the hinge. For certain uses, however, over-center hinges are needed which produce a closing torque only in the vicinity of the closed position, while otherwise the hinge, along with the door mounted on it, can be moved to and fro without force or torque being applied by the spring.

It is therefore the object of the invention to create an over-center, self-closing hinge of this kind, namely one in which a closing torque acts only in the vicinity of the closed position, and to make the over-center mechanism producing this torque so compact that it can be disposed out of sight in the interior of the supporting arm.

SUMMARY OF THE INVENTION

Setting out from a hinge of the kind mentioned above, this problem is solved in accordance with the invention in that the spring is disposed in a swiveling thruster which is displaceable longitudinally relative to the fixed pivot pin of the outer hinge link and whose end remote from the pivot pin is in the form of a cam thrusting against a cross piece provided in the supporting arm; in that during the closing movement the thruster is coupled with the inner hinge link by studs provided on the latter, which engage cam surfaces provided on the sides of the thruster so as to rock the cam-end of the thruster toward the inner hinge link, and that the cam on the end of the thruster has an arcuate section which is concentric with the axis of the fixed pivot pin of the outer hinge link, and a ramp section onto which the cross-piece passes from the arcuate cam section as the hinge comes near to the closed position. This construction of the over-center hinge of the invention makes it possible to dispose the over-center mechanism invisibly within the supporting arm without the need for making the supporting arm larger or of different dimensions than those of normal parallelogram hinges. The hinge can therefore be combined with normal hinges, i.e., hinges having no over-center mechanism, without it being apparent that the hinges are different. If, for example, the closing force of the hinge suffices for a small or light door leaf, the door leaf can be fitted with one hinge made in the manner of the invention and with another, normal hinge matching it in appearance. A reduction in cost is thus achieved by using one instead of two over-center hinges. In the case of large door leaves fitted to the cabinet carcass with more than two hinges, it then also becomes possible to use only two over-center hinges for two of the three or four hinges that are to be used for the mounting of the door.

In a preferred further development of the invention, the hinge links, which are made from flat metal stock by the stamping and pressing method, have their sides bent up at right angles to form cheeks having pivot bores through which the pivot pins on the supporting arm side are passed. The thruster has a width corresponding to or slightly smaller than the inside distance between the cheeks of the links, and on at least one of the cheeks—preferably both of them—of the inner hinge link there is provided a short stud extending toward the thruster and engaging a cam slot provided in the confronting lateral face of the thruster.

If the supporting arm is in the usual channel shape, the crosspiece that is to be provided on the supporting arm can simply be a pin set in opposite bores in the sides of the channel.

The thruster is desirably provided at its cam end with a nose projecting toward the hinge link and engaging this hinge link at a distance from the pivot at the supporting-arm end of the inner hinge link. The distance between the pivot pin and the point of engagement of the nose with the hinge link then constitutes the lever arm at which the deflecting force of the thruster becomes effective, which force is produced by the bias of the spring when the ramp section engages the cross-piece, as the hinge nears the closed position. The longer this lever arm is, the less can be the bias required of the spring.

The spring is preferably a compression coil spring contained under bias in a blind hole provided in the thruster at the opposite end form the cam, and directly engaging at its outer end the fixed pivot pin at one end of the outer hinge link.

BRIEF DESCRIPTION OF THE DRAWINGS

The invention will be further explained in the following description of an embodiment, in conjunction with the drawing wherein.

DETAILED DESCRIPTION OF A PREFERRED EMBODIMENT

Figure 1:
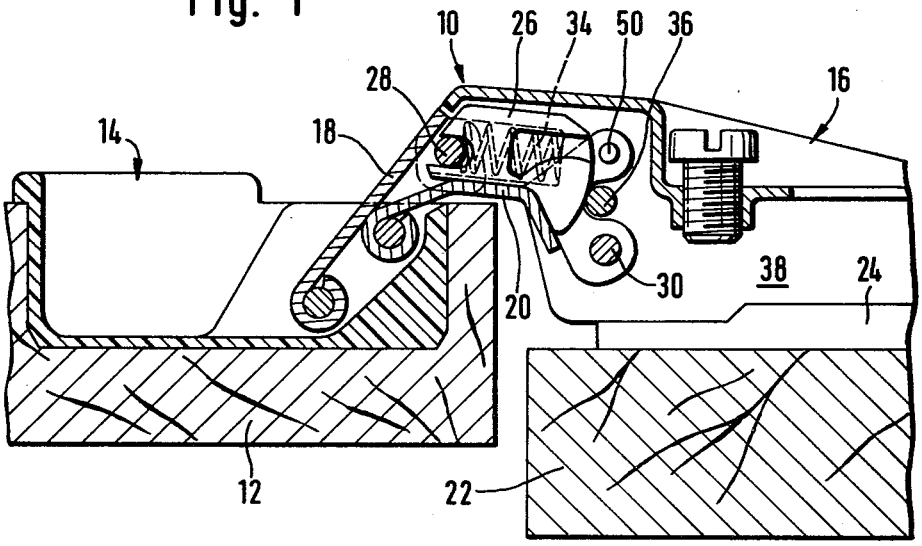
FIG. 1 is a cross-sectional view along the longitudinal central plane of a hinge made in the manner of the invention and represented in the open state.
Figure 2:
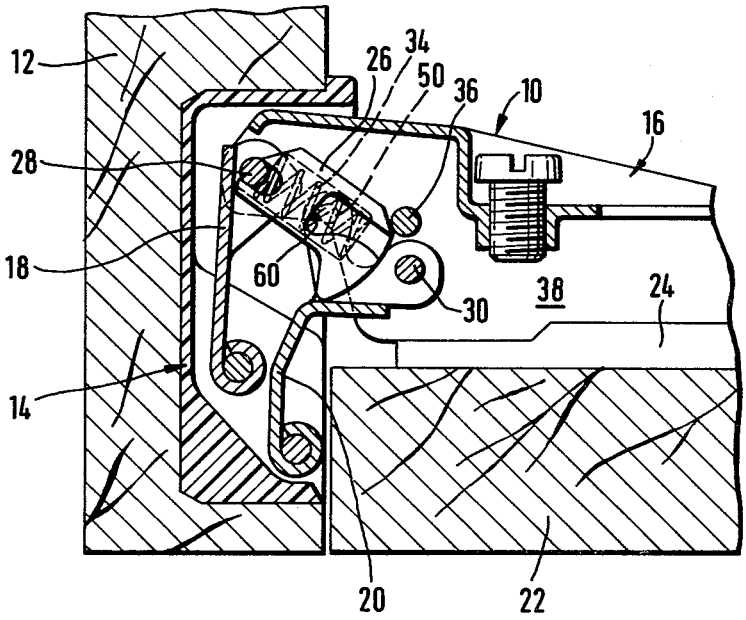
FIG. 2 is a cross-sectional view corresponding to FIG. 1 of the hinge in the closed state.

The hinge in accordance with the invention, designated generally by the number 10 in FIGS. 1 and 2, is a so called four-joint hinge, in which the door-related part in the form of a cup 14, designed to be driven or otherwise set in a mating mortise in the cabinet door 12, is articulated by means of two hinge links 18 and 20 to the jamb-related hinge part which is in the form of an elongated supporting arm 16. The supporting arm 16 is mounted on the jamb 22 of the cabinet through the medium of a mounting plate 24 affixed to the jamb 22 in a known manner. Up to this point the hinge 10 corresponds to conventional four-joint hinges.

Figure 8:
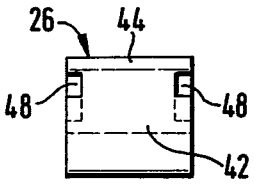
FIG. 8 is a view of the thruster as seen in the direction of the arrow 8 in FIG. 7.
Figure 7:
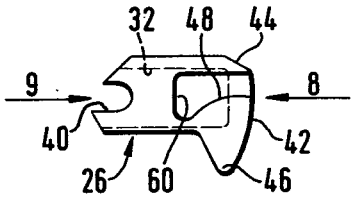
FIG. 7 is a side view of the thruster.
Figure 9:
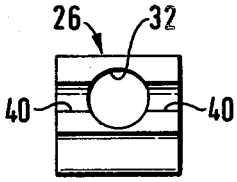
FIG. 9 is a view of the thruster as seen in the direction of the arrow 9 in FIG. 7.

The over-center mechanism of the hinge 10 has a thruster 26 represented separately in FIGS. 7 to 9, which is disposed in the front-end portion of the supporting arm 16 between the fixed pivot pins 28 and 30 on which the hinge links 18 and 20 are held on the supporting arm. In a blind hole 32 in the thruster 26, there is inserted under bias a compression coil spring 34 whose extremity at the open end of the blind hole engages the fixed pivot pin 28 at the end of the outer hinge link 18, i.e., the link farther away from the door jamb. The other end of the thruster 26 is accordingly urged toward the interior of the supporting arm in contact with a cross pin 36 which is disposed in the front end of the supporting arm, parallel to the fixed pivot pins 28 and 30 and, like the fixed pivot pins, is fastened in bores in the side walls 38 of the supporting arm 16. The thruster 26 is provided at its open end with a slot 40 in which the pivot pin 28 is engaged when the thruster is in its properly installed position. This slot 40 enables the thruster to move longitudinally relative to the fixed pin 28 as well as to pivot thereon.

Figure 3:
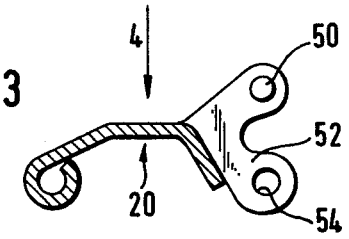
FIG. 3 is a cross-sectional view through the inner hinge link adjacent the jamb.
Figure 4:
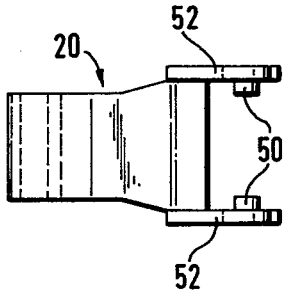
FIG. 4 is a view of the inner hinge link as seen in the direction of the arrow 4 in FIG. 3.

The closed end of the thruster is in the form of a two-section cam composed of a first, circularly arcuate section 42 adjoined at its upper end by a second, ramp-like section 44. The arc of the first cam section 42 is concentric with the fixed pivot pin 28, i.e., its center coincides with the longitudinal central axis of the fixed pin 28. As long as the thruster, therefore, has its cam section 42 in contact with the cross pin 36, no component of force of the bias of the coil spring 34 will develop seeking to rotate the thruster about the pivot pin 28. When the cross pin 36, however, comes within reach of the ramp section 44, the slope of the ramp causes a strong component of the spring force to seek to turn the thruster 26 clockwise. The cam end of the thruster 26 then swings toward the inner hinge link 20 and, by means of a nose 46 prolonging the arcuate cam section 42, presses against the inner hinge link 20. Since the point of engagement of the nose 46 is at a distance from the fixed pivot pin 30, the inner hinge link 20 will be rotated counterclockwise, and thus the closing torque is produced which forces the hinge toward the end position when it nears the closed position. Since a component of force seeking to rotate the thruster is produced, as mentioned, only when its ramp surface 44 is engaged with the cross pin 36, the thruster is coupled to the inner hinge link 20 by a coupling which positively turns the thruster 26 during that portion of the hinge movement during which the hinge turns freely. This coupling is formed by a cam 48 formed in a recess in each of the lateral surfaces of the thruster, and this cam is engaged by short studs 50 projecting towards the thruster from two cheeks 52 bent up at right angles from the supporting-arm end of the inner hinge link 20 which is made from flat material. In FIGS. 3 and 4 can be seen the configuration of the cheeks 52 bearing the studs 50, and it also can be seen that the cheeks 52 contain the pivot bores 54 for the pivot pin 30 of the hinge link 20.

Figure 5:
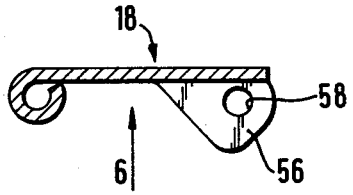
FIG. 5 is a cross-sectional view through the outer hinge link that is farther from the jamb.
Figure 6:
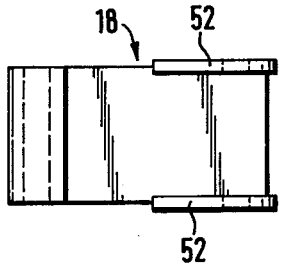
FIG. 6 is a view taken in the direction of the arrow 6 of FIG. 5.

The outer hinge link 18 (FIGS. 5 and 6) also has cheeks 56 turned up from its sides at its supporting-arm end, so that the fixed pivot pin 28 is exposed between the cheeks 56 to receive the thrust of the coil spring 34.

The operation of the above described over-center mechanism is such that, when the hinge swings from the open position shown in FIG. 1 to the closed position (FIG. 2), the studs 50 pass into the recesses containing the cams 48 in the lateral faces of the thruster 26 and, in cooperation with its lower edges defining the cam 48, which curve in the manner represented, swing the thruster 26 clockwise, at first without the nose 46 pressing against the hinge link 20, i.e., the curvature of the said cam 48 is such that the thruster 26 at first only loosely, though positively, follows the changes of the angular position of the inner hinge link 20 during the closing of the hinge. At the same time the arcuate section 42 of the thruster cam slides on the cross pin 36, while all of the compressive force of the spring 34 is exerted against the cross pin 36, since the cam section 42 is concentric with the axis of the pivot pin 28. As soon as the cross pin, however, passes over onto the ramp section 44, a force component of the coil spring 34 turns the thruster 26 toward the hinge link 20 as a result of the change in the shape of the thruster cam, and is transmitted by the nose 46 to the hinge link 20. The studs 50 which have been controlling the thruster up to that point then come away from the cam 48 and stop at a distance from the cam surface in the end 60 of the cam recess, which is sufficiently wide to permit the stud 50 to disengage (FIG. 2). The force component acting through the nose 46 on the inner hinge link 20 then produces on the latter a closing torque which moves the hinge to the closed position and holds it there. The distance between the point of engagement of the nose 46 with the inner hinge link 20 and its fixed pivot axis (pivot pin 30) is, as it can be seen in FIG. 2, relatively great, so that the closing torque resulting from the product of this distance and the closing force component of the spring force achieves, even when relatively weak springs are used, a sufficient magnitude to pull even heavy doors persistently toward the closed position and keep them closed.

When the closed hinge is opened (FIG. 2), the inner hinge link 20 turns the thruster 26 counter-clockwise by its nose 46, while the ramp section 44 slides onto the cross pin 36. As soon as the cross pin 36 passes over onto the cam section 42, the force component, which until then has been seeking to turn the thruster clockwise, vanishes, and the hinge can then be turned effortlessly to the open position shown in FIG. 1. The inner hinge link 20 turns the thruster 26 by its nose 46 positively to the position represented in FIG. 1, i.e., in the return of the thruster the studs 50 on the inner hinge link do not need to cooperate with the upper edge of the recess of cam 48.

I claim:

1. An over-center hinge for cabinet doors, comprising: a door-related hinge part, and a jamb-related hinge part forming an elongated supporting arm, an inner and an outer hinge link pivotingly articulated, in the manner of a four-joint linkage, each being connected to said door-related hinge part at one end and to said supporting arm at another end, said hinge being movable from an open to a closed position and vice versa, first and second pivot pins respectively at the supporting-arm end of said inner and outer hinge links, a thruster which is longitudinally displaceable and rotatable with relation to said second pivot pin, and having an end remote from said second pivot pin which is in the form of a cam thrusting against a crosspiece provided in said supporting arm, a spring under compressive bias thrusting with one end against said second pivot pin, the bias of said spring acting at another end of the spring by continuously thrusting said cam against said inner hinge link at a distance from the supporting-arm end of said inner hinge link to produce a hinge closing torque as the hinge approaches the closed position, a slideway-and-stud coupling connecting said thruster with said inner hinge link, said coupling being engaged during closing movement for the purpose of turning the cam end of the thruster-toward said inner hinge link, said cam having a circuularly arcuate section that is concentric with an axis of said second pivot pin, and adjoining said arcuate section on said cam being a ramp section onto which said crosspiece passes from said arcuate section as the closed position of the hinge is approached with said cam end which has been turned by the coupling exerting the hinge closing torque against the inner hinge link.

2. A hinge according to claim 1, wherein said hinge links are flat metal parts having at the supporting arm end cheeks bent up laterally at right angles, pivot bores being provided in said cheeks through which said first and second pins at the supporting-arm end pass; said thruster having a width corresponding to or slightly smaller than the clearance between said cheeks, said slideway-and-stud coupling comprising a short stud on at least one of said cheeks of said inner hinge link and projecting towards said thruster, and comprising a slideway engaged by said stud and provided in a confronting side surface of said thruster.

3. An over-center hinge according to claim 1 or 2, in which said supporting arm is in the form of a U turned at 180°, said crosspiece being a cross pin fixed in bores in two supporting arm cheeks formed by limbs of the U.

4. An over-center hinge according to claim 3, wherein said spring is a coil spring inserted under compressive bias into an elongated recess in said thruster, said recess is closed at the cam end and open at the end opposite the cam, and whose end situated in the open end of the thruster thrusts directly at the second pivot pin.

5. An over-center hinge according to claim 1 or 2, wherein said thruster has on said cam end a nose projecting towards the inner hinge link, and said nose engages the inner hingge link at a distance from said first pivot pin.

6. An over-center hinge according to claim 5, wherein said spring is a coil spring inserted under compressive bias into an elongated recess in said thruster, said recess is closed at the cam end and open at the end opposite the cam, and whose end situated in the open end of the thruster thrusts directly at the second pivot pin.

7. An over-center hinge according to claim 1 or 2, wherein said spring is a coil spring inserted under compressive bias into an elongated recess in said thruster, said recess is closed at the cam end and open at the end opposite the cam, and whose end situated in the open end of the thruster thrusts directly at the second pivot pin.

* * * * *